US006707036B2

(12) United States Patent
Makarov et al.

(10) Patent No.: US 6,707,036 B2
(45) Date of Patent: Mar. 16, 2004

(54) IONIZATION APPARATUS AND METHOD FOR MASS SPECTROMETER SYSTEM

(75) Inventors: Alexander A. Makarov, Cheshire (GB); Pavel V. Bondarenko, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 2 days.

(21) Appl. No.: 10/105,172

(22) Filed: Mar. 21, 2002

(65) Prior Publication Data

US 2003/0178562 A1 Sep. 25, 2003

(51) Int. Cl.[7] ..... H01J 49/00
(52) U.S. Cl. ..... 250/288
(58) Field of Search ..... 250/281–283, 250/288, 433 R, 424–425, 423 P

(56) References Cited

U.S. PATENT DOCUMENTS 6,504,150 B1 * 1/2003 Verentchikov et al. ..... 250/286

* cited by examiner

*Primary Examiner*—John R. Lee
*Assistant Examiner*—Christopher M. Kalivoda
(74) *Attorney, Agent, or Firm*—Dorsey & Whitney LLP

(57) ABSTRACT

An ionization apparatus for connection to a mass analyzer is provided. The ionization apparatus comprises a sample slide having at least two sample spots containing analytes to be analyzed by a mass analyzer, means for delivering energy to one of the sample spots to release and ionize the analytes to form ions, and an interface connecting the one of the sample spot to the analyzer. The interface comprises a chamber having an orifice in close proximity to the one of the sample spots and defining a first region encompassing the one of the sample spots, and an ion guide disposed in the chamber and leading to the mass analyzer in a second region. Means for sustaining a pressure substantially lower than atmospheric within the first region is provided for capturing the ions while other sample spots are maintained at atmospheric pressure. Means for sustaining a pressure within the second region substantially lower than the pressure within the first region is provided.

46 Claims, 3 Drawing Sheets

IONIZATION APPARATUS AND METHOD FOR MASS SPECTROMETER SYSTEM

FIELD OF THE INVENTION

This invention relates generally to the field of mass spectrometry, and more particularly to sample ionization for mass spectrometer system. More particularly, this invention relates to an ionization apparatus and method for connection to a mass analyzer to improve mass analysis by seamlessly combining sample ionization and sample analysis.

BACKGROUND OF THE INVENTION

Mass analysis of any sample in a mass spectrometer requires sample ionization as a first step. Sample ionization can be performed under either vacuum or atmospheric pressure. Vacuum ionization techniques include electron impact ionization, fast ion bombardment, secondary ion ionization, and matrix-assisted laser deposition/ionization. Vacuum ionization occurs inside a mass spectrometer instrument under vacuum conditions. A disadvantage of vacuum ionizations is that a sample support must be inconveniently introduced into the vacuum via vacuum locks, making the linking of mass spectrometry with chromatographic and electrophoretic separation methods more difficult.

Atmospheric pressure ionization takes place outside of a mass spectrometer instrument. To sample atmospheric pressure ions, a mass spectrometer must be equipped with an atmospheric pressure interface (APE) to transfer ions from an external region at atmospheric pressure to a mass analyzer under high vacuum. Atmospheric pressure ionization techniques include atmospheric pressure chemical ionization and electrospray ionization (ESI) among others. One problem of many prior art atmospheric pressure ionization techniques is the low transmission efficiency of sample ions to a mass analyzer due to ion losses and low throughput of ions for mass analysis due to non-seamless connection of atmospheric sample ionization and sample analysis under high vacuum.

U.S. Pat. No. 5,663,561 describes a device and method for ionizing analyte molecules at atmospheric pressure by chemical ionization. According to this method, the analyte molecules deposited together with a decomposable matrix material are first blasted in the surrounding gas under atmospheric pressure to produce neutral gas-phase analyte molecules. Then these neutral gas-phase analyte molecules are ionized by atmospheric pressure chemical ionization. This method requires that the desorption of the analyte be carried out as a separate step from the ionization of the analyte.

U.S. Pat. No. 5,965,884 describes an atmospheric pressure matrix assisted laser desorption ionization (AP-MALDI) ion source. The AP-MALDI apparatus contains an atmospheric pressure ionization chamber hosting a sample to be analyzed, a laser system outside the ionization chamber, and an interface that connects the ionization chamber to the spectrometer. While this AP-MALDI apparatus combines analyte desorption and ionization in a single step, it cannot be operated at an optimum pressure regime, and ion transmission from the ionization chamber to the spectrometer is low. Moreover, analyte adducting is high and undesired molecular clusters are formed during the ionization process.

EP 0964427 A2 describes a MALDI ion source operating at pressures greater than 0.1 torr. While the claimed ion source may be operated at a greater pressure range, it has the same problems as U.S. Pat. No. 5,965,884: low ion transmission, high adducting among analytes and other molecules and undesired cluster formation.

WO 99/38185 and U.S. Pat. No. 6,331,702 B1 describe a spectrometer provided with a pulsed ion source and transmission device to damp ion motion and method of use. This design requires a sample loading chamber or lock chamber and a low pressure MALDI ion source, and has limited throughput.

WO 00/77822 A2 describes a MALDI ion source that is enclosed in a chamber and operated under a low pressure and has a limited throughput.

OBJECTS AND SUMMARY OF THE INVENTION

Accordingly it is an object of the present invention to provide an ionization apparatus for connecting to a mass analyzer to seamlessly combine sample ionization and sample analysis.

It is another object of the present invention to provide an ionization apparatus for fast sample scanning to increase throughput of mass analysis.

It is a further object of the present invention to provide an ionization apparatus which allows sample preparation at atmospheric pressure to increase reliability and reduce construction cost of mass analysis systems.

In accordance with the invention, there is provided an ionization apparatus for connection to a mass analyzer. The ionization apparatus comprises a sample slide having at least two sample spots containing analytes to be analyzed by a mass analyzer, means for delivering energy to one of the sample spots to release and ionize the sample analytes to form sample ions, and an interface for supplying the sample ions to the mass analyzer. The interface comprises a chamber having an orifice in close proximity to the irradiated sample spot and defining a first region encompassing the irradiated sample spot. An ion guide is disposed in the chamber and leads to the mass analyzer in a second region. Means for sustaining a pressure substantially lower than atmospheric within the first region is provided for capturing the ions while other sample spots are maintained at atmospheric pressure. Means for sustaining a pressure within the second region substantially lower than the pressure within the first region is provided.

The means for delivering energy is disposed such that the energy irradiates one of the sample spot through the orifice in front of the irradiated sample spot. Alternatively, the means for delivering energy is disposed such that the energy irradiates one of the sample spots from the back of a transparent sample slide.

The ionization apparatus may comprise a motorized stage for moving the sample slide to sequentially present sample spots to the first region. The motorized stage can be computer controlled and moveable in three dimensions. The sample slide is preferably disposed in proximity of about from 50 to 100 microns to the interface.

The ionization apparatus may comprise a cover slide that seamlessly takes place of the sample slide with the same proximity to the orifice when the sample slide moves away during sample change.

The means for sustaining a pressure substantially lower than atmospheric within the first region can maintain a pressure from few torr to few tens torr. The means for sustaining a pressure within the second region can maintain a pressure from about 0.001 to about 0.1 torr.

In another embodiment of the present invention, there is provided an ionization apparatus further comprising an external groove surrounding the orifice to stabilize the pressure within the first region. This ionization apparatus may further comprise spacing balls for engaging the sample slide and the interface to accurately space the slide from the orifice.

In another aspect of the present invention, there is provided a method for ionizing analytes in a sample for mass spectrometer analysis. The method comprises providing a sample slide having at least two sample spots containing analytes to be analyzed by a mass analyzer and providing an interface connecting one of the sample spots to the analyzer. The interface is provided with a chamber having an orifice in close proximity to one of the sample spots and defining a first region encompassing the sample spot. An ion guide is disposed in the chamber leading to the mass analyzer in a second region. Energy is delivered to one of the sample spots to release and ionize the analytes to form ions. A pressure substantially lower than atmospheric is sustained within the first region while maintaining atmospheric pressure at other sample spots. A pressure within the second region substantially lower than the pressure within the first region is provided.

BRIEF DESCRIPTION OF THE DRAWINGS

The foregoing and other objects of the invention will be more clearly understood from the following description when read in conjunction with the accompanying drawings in which.

DESCRIPTION OF PREFERRED EMBODIMENTS

Figure 1:
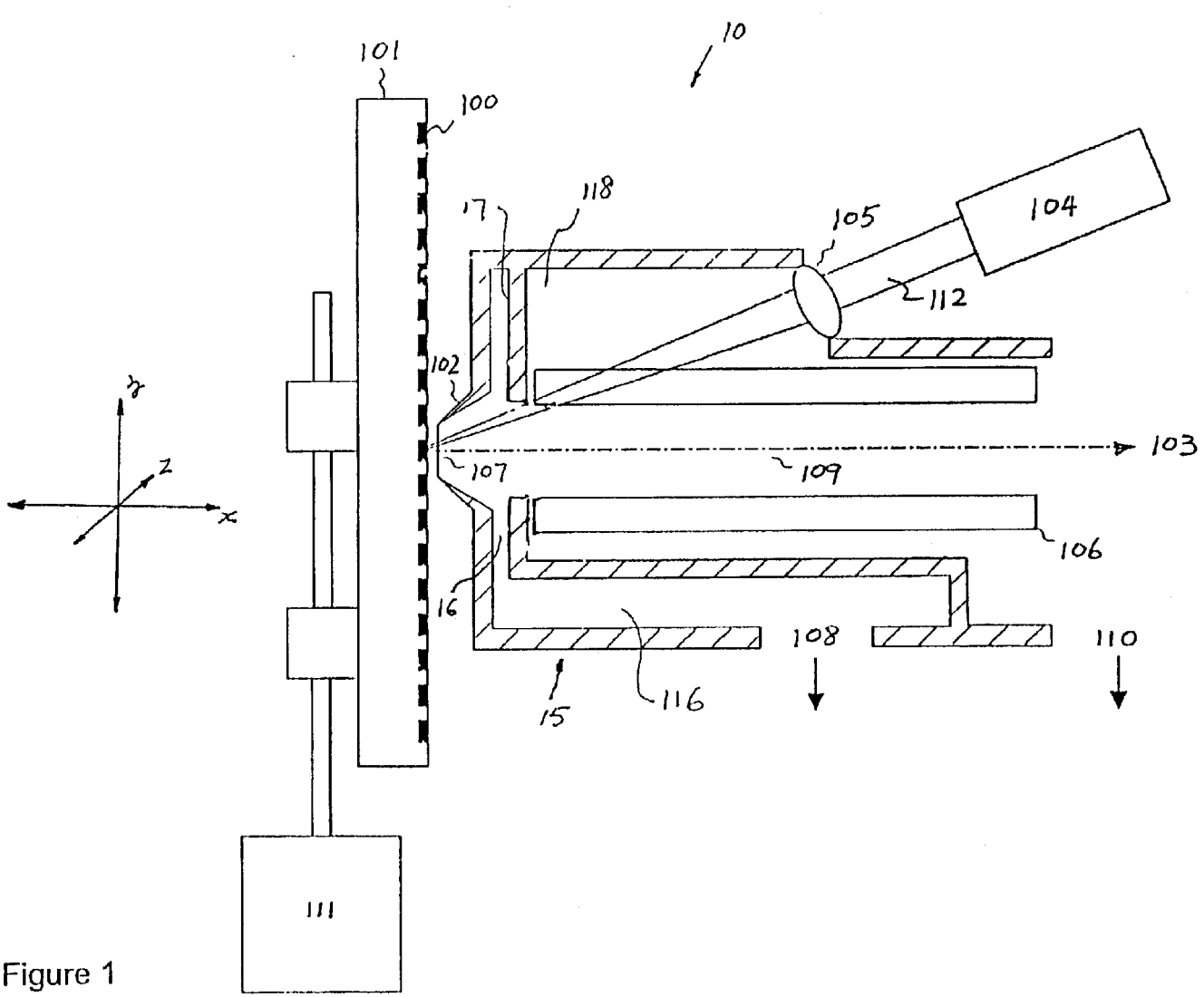
FIG. 1 is a schematic view of an ionization apparatus including a laser source delivering energy to a sample spot through an orifice in front of a sample slide.

FIG. 1 shows an embodiment 10 of an ionization apparatus of the present invention. This ionization apparatus 10 comprises a sample slide 101 having at least two sample spots 100 containing sample analytes to be ionized, a laser source 104 for delivering energy 112 to one of the sample spots 100 through a focus lens 105. The energy 112 ionizes the sample at the irradiated sample spot 100. An interface 15 collects ions generated at the irradiated sample spot 100 and delivers them to a mass analyzer (not shown) as indicated by arrow 103. The mass analyzer 103 can comprise a time of flight (TOF) mass analyzer, an ion trap mass analyzer, an orbitrap mass analyzer, a magnetic sector mass analyzer, or a Fourier transform mass analyzer.

The sample slide 101 is maintained at atmospheric pressure and brought in close proximity to the interface 15 by a motorized stage 111. The motorized stage 111 is computer controlled and movable in three dimensions (x, y, z). A plurality of sample spots 100 are provided on the sample slide 101 so that they are brought sequentially into position for ionization and analysis. Each individual sample spot 100 is brought sequentially in registration with the interface 15 by driving the motorized stage 111 controlled by a computer (not shown). Materials that can be used for the sample slide 101 include electrically conductive metals such as stainless steel, insulating polymers such as teflon, and porous silica. It is apparent that the sample can be deposited together with a decomposable matrix material at the sample spot 100 and the sample slide can be moved in the x-y-z directions to bring the spot in registration with the orifice 102 of the interface 15. A cover slide (not shown) seamlessly takes place of the sample slide with the same proximity to the orifice during sample change.

The walls of interface 15 form a chamber 118 having an orifice 102 which captures ions generated at the irradiated sample spot 100. An ion guide 106 is disposed in the chamber 118 to transport ions to the mass analyzer as indicated by arrow 103. Preferably, the orifice 102 is in the shape of a truncated cone and is brought into a close proximity to the sample slide 101 so that the irradiated sample spot 100 is located opposite the opening of the cone. The distance between the irradiated sample spot 100 and the front surface of the orifice 102 can be precisely controlled by moving the motorized stage 111 in the x direction. Preferably, the distance is within from about 50 to 100 microns. A wall 17 is spaced from the end of the interface walls to define a subchamber 16 adjacent to the orifice 102. A pump (not shown) is connected to port 108 which communicates with the subchamber to sustain a pressure within the region 107 of the orifice 102 which is higher than the pressure in chamber 118. The pump can be a rotary vacuum pump and sustain a pressure from few torr to few tens torr at the sample spot 100 being ionized. Accordingly, the region surrounding the sample spot 100 being ionized can be sustained a pressure substantially lower than atmospheric while other sample spots 100 outside the region 107 encompassed by the orifice 102 are maintained at atmospheric pressure.

An ion guide 106 is disposed inside the chamber 118 and extends from the orifice 102 to a mass analyzer 103, forming a multipole region 109 through which sample ions are transported by combination of gas flows and electric fields. The ion guide 106 can be any transmission or trapping device. Preferably the ion guide 106 is a RF-only multipole and can be heated. A turbo pump (not shown) is connected to a port 110 for sustaining a vacuum within the chamber 118. A valve (not shown) is also equipped at port 110 so that the pressure within the multipole region 109 can be adjusted from 0.001 to 0.1 torr for optimal performance.

A laser source 104 delivers energy such as a UV light, visible light, or IR light 112 through a lens 105, which focuses the energy on one of the sample spots to release and ionize the sample. The laser source 104 can irradiate pulsed or continuous energy to at least one sample at a time. In this embodiment 10 of the ionization apparatus, the laser source 104 and the lens 105 are disposed such that laser energy 112 is delivered to one of the sample spots 100 through the orifice 102 in front of the sample spot 100.

Figure 2:
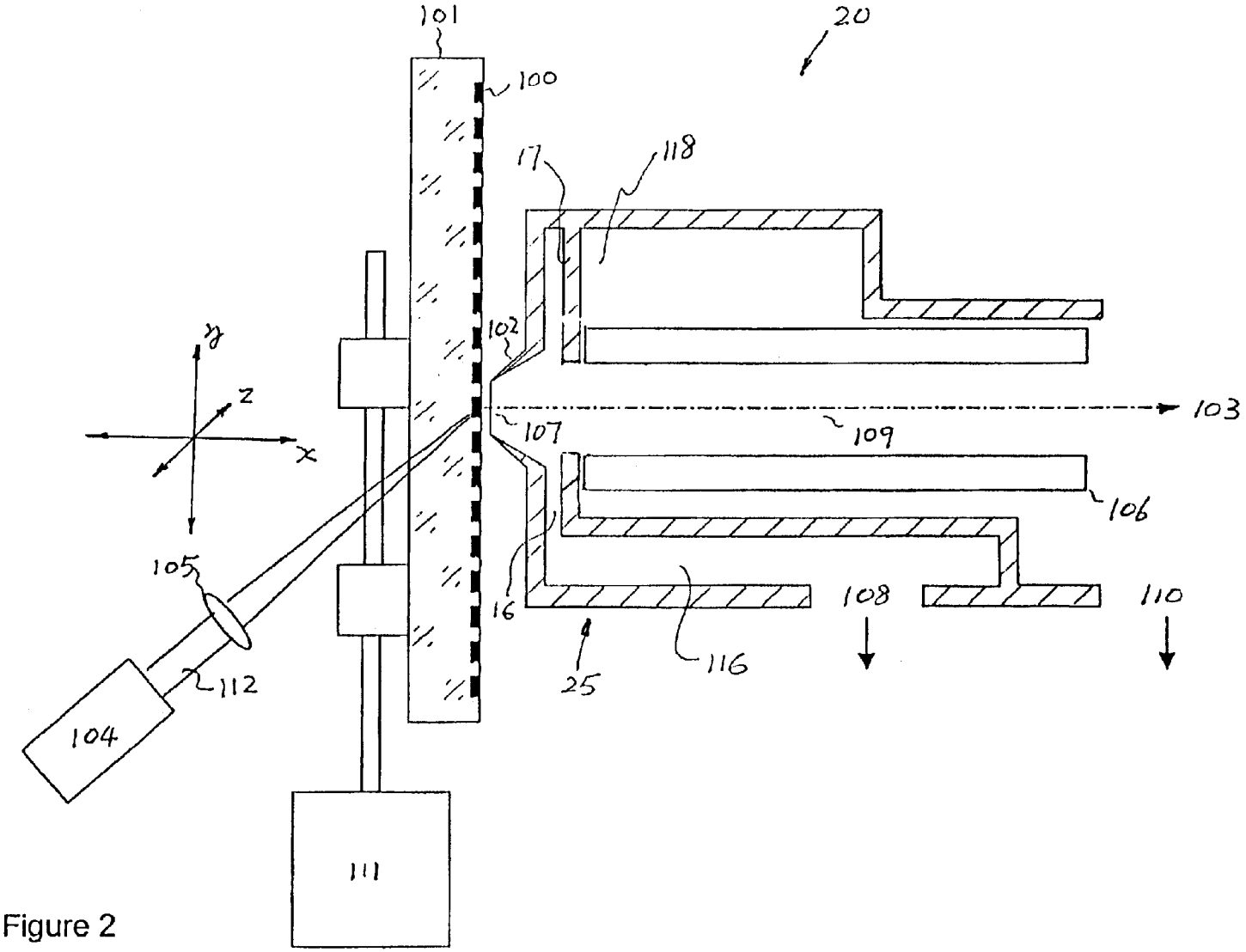
FIG. 2 is a schematic view of an ionization apparatus including a laser source delivering energy to a sample spot from the back of a transparent sample slide.

FIG. 2 shows another embodiment 20 of the ionization apparatus of the present invention. The laser source 104 and the lens 105 are disposed such that the laser energy 112 is delivered to one of the sample spots 100 from the back of the sample slide 101, either through a transparent slide, or the sample can be on the end of a transparent optical fiber. Preferably the sample slide or optical fiber is made of quartz.

Figure 3:
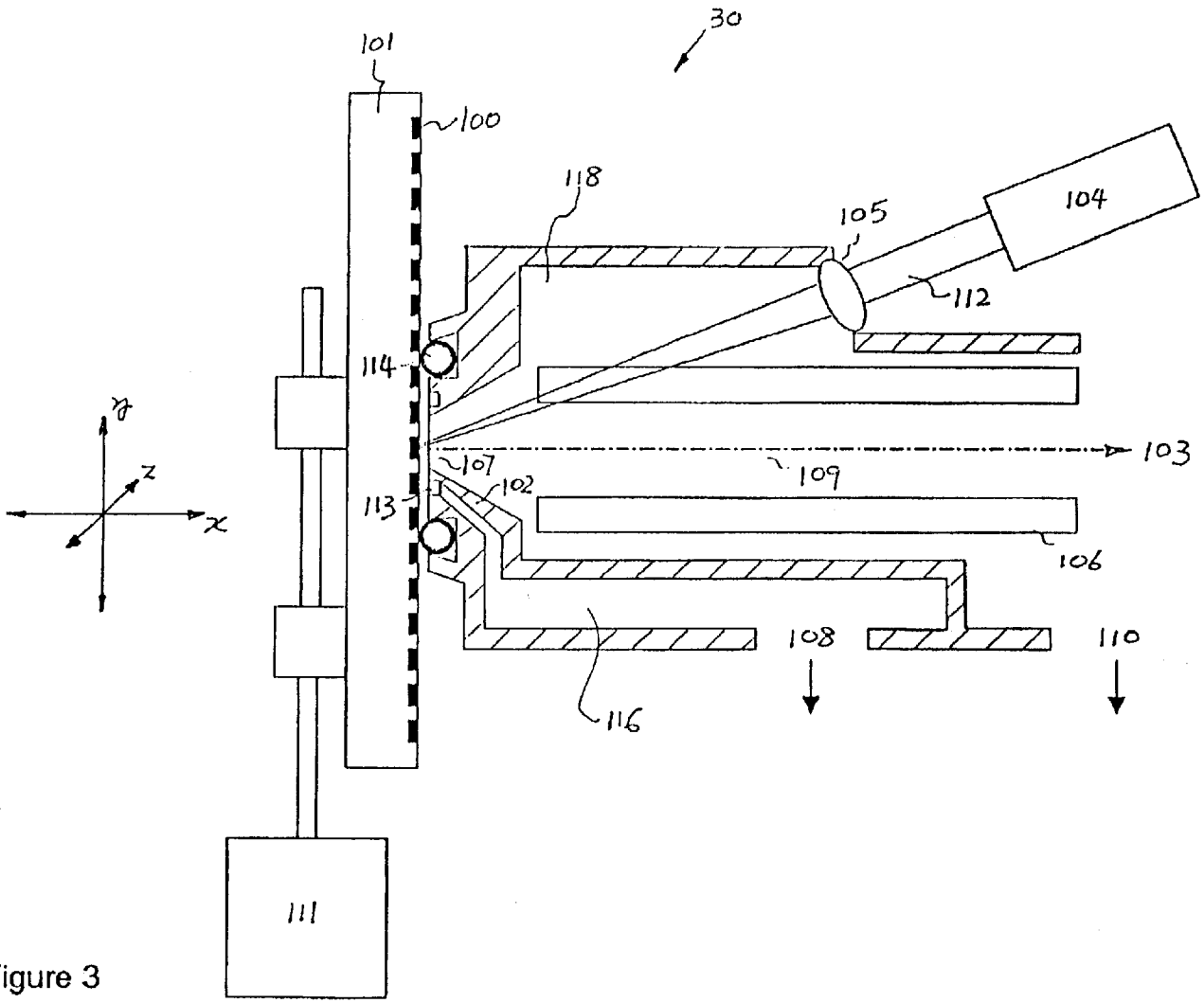
FIG. 3 is a schematic view of an ionization apparatus having an interface including a groove and spacing balls at an orifice in front of the sample slide.

FIG. 3 shows another embodiment 30 of the ionization apparatus of the present invention. In comparison with embodiments 10 and 20, embodiment 30 has an external groove 113 surrounding the orifice at the end of the chamber 118. The groove 113 is evacuated through the chamber passage 116 connected to port 108, preferably by a rotary pump connected to the port 108. This increases robustness of the differential pumping and stability of the pressure in the orifice region 107. To further increase stability of the pressure in the orifice region 107, the gap between the sample slide 101 and the orifice 102 is fixed by introducing spaced ball bearings 114. This design provides a greater precision and accuracy for the gap between the sample slide 101 and orifice 102. The ball size can be chosen large enough, so that the balls roll over the sample spots 100 without reaching the bottoms of the wells 100 in which the samples are located. This embodiment 30 can use either front or back laser irradiation as illustrated in embodiments 10 and 20.

One advantage of the present invention is that sample analysis may be seamlessly combined with sample ionization that makes the system ideal for high-throughput proteomics. Ion losses on the orifice are low. Another advantage is that vacuum seals are not needed between the sample spot being ionized and other spots. The motorized stage moving the sample slide can be operated at atmospheric pressure. This results in higher reliability and lower construction cost of ionization system. Moreover, the present ionization apparatus can increase throughput up to 1 second per sample due to fast sample scanning and no time losses on sample introduction. The ionization system of the present invention is also advantageous in that it is easy to automate and interchangeable with ESI ion source, thus both proteomic tools can be used in parallel for the same sample.

The foregoing description of specific embodiments and examples of the invention have been presented for the purpose of illustration and description, they are not intended to be exhaustive or to limit the invention to the precise forms disclosed. Obviously many modifications, embodiments, and variations are possible in light of the above teaching. It is intended that the scope of the invention encompass the generic area as herein disclosed, and by the claims appended hereto and their equivalents.

What is claimed is:

1. An ionization apparatus for connection to a mass analyzer, comprising:

a sample slide having at least two sample spots, said sample spots containing analytes to be analyzed by said mass analyzer;

means for delivering energy to one of the sample spots to release and ionize said analytes to form ions;

an interface connecting said one of the sample spots to said analyzer, said interface comprising a first chamber having an orifice in close proximity to said one of the sample spots and defining a first region encompassing said one of the sample spots, and an ion guide disposed in a second chamber defining a second region;

means for sustaining a pressure substantially lower than atmospheric within said first region for capturing said ions while other sample spots are maintained at atmospheric pressure; and means for sustaining a pressure within said second region substantially lower than said pressure within said first region.

2. The ionization apparatus of claim 1 wherein said interface further includes a groove surrounding said orifice.

3. The ionization apparatus of claim 2 wherein said interface further includes spaced balls adapted to engage said sample slide and said orifice to space said slide from said orifice.

4. The ionization apparatus of claim 1 wherein said means for delivering energy is disposed such that said energy is delivered to said one of the sample spots through said orifice.

5. The ionization apparatus of claim 4 wherein said sample slide is made of a material selected from a group consisting of electrically conductive metal, insulating polymers, and porous silica.

6. The ionization apparatus of claim 1 wherein said sample slide is made of a transparent material and said means for delivering energy is disposed such that said energy is delivered to said one of the sample spots through said sample slide.

7. The ionization apparatus of claim 6 wherein said sample slide is made of quartz.

8. The ionization apparatus of claim 1 further comprising a motorized stage for moving said sample slide to sequentially present sample spots to said first region.

9. The ionization apparatus of claim 8 wherein said motorized stage is computer controlled and moveable in three dimensions (x, y, z).

10. The ionization apparatus of claim 1 wherein said sample slide is disposed in proximity of about 50 to 100 microns to said interface.

11. The ionization apparatus of claim 1 further comprising a cover slide for seamlessly taking place of the sample slide with the same proximity to the orifice during sample change.

12. The ionization apparatus of claim 1 wherein said orifice is in a shape of a truncated cone.

13. The ionization apparatus of claim 1 wherein said ion guide is a RF-only multipole.

14. The ionization apparatus of claim 1 wherein said means for sustaining a pressure substantially lower than atmospheric within said first region maintains a pressure from few torr to few tens torr.

15. The ionization apparatus of claim 1 wherein said means for sustaining a pressure within said second region maintains a pressure from about 0.001 to 0.1 torr.

16. The ionization apparatus of claim 1 wherein said sample slide contains a plurality of spaced spots, and drive means for bringing an individual spot sequentially in registration with said first region.

17. An interface device for connecting an ion source with a mass analyzer, comprising:

a first chamber having an orifice in close proximity to said ion source, said orifice defining a first region encompassing said ion source;

an ion guide disposed in a second chamber defining a second region;

means for sustaining a pressure substantially lower than atmospheric within said first region for capturing ions; and means for sustaining a pressure within said second region substantially lower than said pressure within said first region.

18. The interface device of claim 17 further including a groove surrounding said orifice.

19. The interface device of claim 17 further including spaced balls adapted to engage said orifice and a sample slide to space said slide from said orifice.

20. The interface device of claim 17 wherein said orifice is in a shape of a truncated cone.

21. The interface device of claim 17 wherein said ion guide is a RE-only multipole.

22. The interface device of claim 17 wherein said means for sustaining a pressure substantially lower than atmospheric within said first region maintains a pressure from few torr to few tens torr.

23. The interface device of claim 17 wherein said means for sustaining a pressure within said second region maintains a pressure from about 0.001 to 0.1 torr.

24. A mass spectroscopic system, comprising:

a mass analyzer;

an ion source; and an interface device connecting said mass analyzer with said ion source, said interface device comprising:

a first chamber having an orifice in close proximity to said ion source, said orifice defining a first region encompassing said ion source;

an ion guide disposed in a second chamber defining a second region;

means for sustaining a pressure substantially lower than atmospheric within said first region for capturing said ions; and means for sustaining a pressure within said second region substantially lower than said pressure within said first region.

25. The mass spectroscopic system of claim 24 wherein said interface device further comprises a groove surrounding said orifice.

26. The mass spectroscopic system of claim 24 wherein said interface device further comprises spaced balls adapted to engage said orifice and a sample slide to space said slide from said orifice.

27. A method for ionizing analytes in a sample for mass analysis, comprising:

providing a sample slide having at least two sample spots, said sample spots containing analytes to be analyzed by a mass analyzer;

providing an interface connecting one of the sample spots to said mass analyzer, said interface is provided with a chamber having an orifice in close proximity to said one of the sample spots and defining a first region encompassing said one of the sample spots;

delivering energy to said one of the sample spots to release and ionize said analytes to form ions; and sustaining a pressure lower than atmospheric within said first region for capturing said ions while maintaining atmospheric pressure at other sample spots.

28. The method of claim 27 further comprising moving said sample slide in three dimensions (x, y, z) to present sequentially sample spots to said first region.

29. The method of claim 27 wherein said pressure within said first region is maintained from few torr to few tens torr.

30. The method of claim 27 further providing an ion guide disposed in a second chamber defining a second region and the pressure within said second region is maintained from about 0.001 to about 0.1 torr.

31. An ionization apparatus for connection to a mass analyzer, comprising:

a sample slide having at least two sample spots, said sample spots containing analytes to be analyzed by said mass analyzer;

means for delivering energy to one of the sample spots to release and ionize said analytes to form ions;

an interface connecting said one of the sample spots to said analyzer, said interface comprising a chamber having an orifice in close proximity to said one of the sample spots and defining a first region encompassing said one of the sample spots, and an ion guide disposed in said chamber and leading to said mass analyzer in a second region, said interface including a groove surrounding said orifice and spaced balls adapted to engage said sample slide and said orifice to space said slide from said orifice;

means for sustaining a pressure substantially lower than atmospheric within said first region for capturing said ions while other sample spots are maintained at atmospheric pressure; and means for sustaining a pressure within said second region substantially lower than said pressure within said first region.

32. The ionization apparatus of claim 31 wherein said means for delivering energy is disposed such that said energy is delivered to said one of the sample spots through said orifice.

33. The ionization apparatus of claim 32 wherein said sample slide is made of a material selected from a group consisting of electrically conductive metal, insulating polymers, and porous silica.

34. The ionization apparatus of claim 31 wherein said sample slide is made of a transparent material and said means for delivering energy is disposed such that said energy is delivered to said one of the sample spots through said sample slide.

35. The ionization apparatus of claim 34 wherein said sample slide is made of quartz.

36. The ionization apparatus of claim 31 further comprising a motorized stage for moving said sample slide to sequentially present sample spots to said first region.

37. The ionization apparatus of claim 36 wherein said motorized stage is computer controlled and moveable in three dimensions (x, y, z).

38. The ionization apparatus of claim 31 wherein said sample slide is disposed in proximity of about 50 to 100 microns to said interface.

39. The ionization apparatus of claim 31 further comprising a cover slide for seamlessly taking place of the sample slide with the same proximity to the orifice during sample change.

40. The ionization apparatus of claim 31 wherein said orifice is in a shape of a truncated cone.

41. The ionization apparatus of claim 31 wherein said ion guide is a RF-only multipole.

42. The ionization apparatus of claim 31 wherein said means for sustaining a pressure substantially lower than atmospheric within said first region maintains a pressure from few torr to few tens torr.

43. The ionization apparatus of claim 31 wherein said means for sustaining a pressure within said second region maintains a pressure from about 0.001 to 0.1 torr.

44. The ionization apparatus of claim 31 wherein said sample slide contains a plurality of spaced spots, and drive means for bringing an individual spot sequentially in registration with said first region.

45. An interface device for connecting an ion source with a mass analyzer, comprising:

a chamber having an orifice in close proximity to said ion source, said orifice defining a first region encompassing said ion source;

a groove surrounding said orifice;

spaced balls adapted to engage said orifice and a sample slide to space said slide from said orifice;

an ion guide disposed in said chamber and leading to said mass analyzer in a second region;

means for sustaining a pressure substantially lower than atmospheric within said first region for capturing ions; and means for sustaining a pressure within said second region substantially lower than said pressure within said first region.

46. A mass spectroscopic system, comprising:

a mass analyzer;

an ion source; and an interface device connecting said mass analyzer with said ion source, said interface device comprising:

a chamber having an orifice in close proximity to said ion source, said orifice defining a first region encompassing said ion source;

a groove surrounding said orifice;

spaced balls adapted to engage said orifice and a sample slide to space said slide from said orifice;

an ion guide disposed in said chamber and leading to said mass analyzer in a second region;

means for sustaining a pressure substantially lower than atmospheric within said first region for capturing said ions; and means for sustaining a pressure within said second region substantially lower than said pressure within said first region.

* * * * *